US006537030B1

(12) United States Patent
Garrison

(10) Patent No.: US 6,537,030 B1
(45) Date of Patent: Mar. 25, 2003

(54) SINGLE PIECE IMPELLER HAVING RADIAL OUTPUT

(75) Inventor: Bobby D. Garrison, Cassville, MO (US)

(73) Assignee: Fasco Industries, Inc., Cassville, MO (US)

( * ) Notice: Subject to any disclaimer, the term of this patent is extended or adjusted under 35 U.S.C. 154(b) by 0 days.

(21) Appl. No.: 09/974,468

(22) Filed: Oct. 10, 2001

Related U.S. Application Data

(60) Provisional application No. 60/241,529, filed on Oct. 18, 2000.

(51) Int. Cl.[7] ..... F04D 29/24; F04D 29/30

(52) U.S. Cl. ..... 416/185; 416/234

(58) Field of Search ..... 416/185, 186 R, 416/194, 195, 196 R, 234, 241 A

(56) References Cited

U.S. PATENT DOCUMENTS

| | | | | |
|---|---|---|---|---|
| 3,692,428 A | * | 9/1972 | Bubb et al. | 416/187 |
| 3,846,043 A | * | 11/1974 | Wolbrink et al. | 416/186 R X |
| 5,478,206 A | | 12/1995 | Prahst | |
| 5,895,206 A | * | 4/1999 | Chuang et al. | 416/189 |
| 6,095,752 A | * | 8/2000 | Gronier et al. | 416/195 X |

* cited by examiner

*Primary Examiner*—Edward K. Look
*Assistant Examiner*—Kimya N McCoy
(74) *Attorney, Agent, or Firm*—Andrus, Sceales, Starke & Sawall, LLP

(57) ABSTRACT

A single piece impeller that includes an integrally formed hub, back plate, inlet support ring and a plurality of impeller blades. The impeller blades each extend radially from an inner, leading edge to an outer, trailing edge. An extended portion of each impeller blade extends past the outer edge surface of the back plate such that the extended portion is not support along a lower edge surface. The top edge surface of the extended portion of each impeller blade is integrally formed with the support ring. The support ring provides support for each of the impeller blades and is sized to allow the single piece impeller to be removed from a mold.

10 Claims, 4 Drawing Sheets

SINGLE PIECE IMPELLER HAVING RADIAL OUTPUT

CROSS-REFERENCE TO RELATED APPLICATION

The present invention is based on and claims priority to U.S. Provisional Patent Application Serial No. 60/241,529, filed on Oct. 18, 2000.

FIELD OF THE INVENTION

The present invention is directed to impellers, and more particularly to an impeller manufactured as single piece having the optimal manufacturability, lowest cost, most efficient design, and lowest material usage to provide superior capabilities with respect to cost without sacrificing durability.

BACKGROUND OF THE INVENTION

Impellers have been around for many years as a tool for creating a flow of either a gas or a liquid. Common uses for impellers have been for cooling mechanical or electrical devices by creating a flow of a cooling medium. There are two main design considerations for an impeller: the cost of manufacture and durability in the desired environment.

An example of an impeller known in the art is that disclosed in U.S. Pat. No. 5,478,206 to Prahst. The Prahst patent discloses an impeller having a guide ring for a radial fan made to direct a flow of a medium directly onto an object. While the impeller blades for the radial fan in Prahst can be made in one piece, the design lacks the essential element of a rear support plate. To direct the flow of fluid out radially from the impeller, one would need to add a rear support plate or a frame to direct the flow. The addition of a rear plate typically involves costly secondary processing and assembly. The present invention addresses deficiencies involving radial output fans while maintaining the benefit of one-piece manufacture.

The present invention relates to an impeller primarily used with AC motors or blowers. However, the impeller of the present invention may easily be adapted to any impeller that can be made by the injection molding process or any processes that involve male and female reusable mold halves which shape a deformable material. The common material used to make impellers has been synthetic materials, such as thermoplastics, where the service conditions allow. The prior art method for producing impellers out of thermoplastics involved the injection molding of impellers in two pieces.

Once the two halves of the prior art injection molded impeller were molded, the two halves were removed and inspected. If the parts proved to be of sufficient quality, the two halves undergo a second processing step of friction welding. Friction welding involves the heating of a thermoplastic part through friction, as the name implies. Friction is generally created by spinning a first half of the part, which is anchored to a large rotating mass, and forcibly pressing the first half against the second half of the part which mounted firmly in place. The movement of the two plastic parts against each other causes intense heat from the friction between the touching surfaces. The intense heat causes the two components to melt, flow and knit together.

The disadvantages of friction welding are numerous. The first disadvantage of friction welding is that it excludes many intricate and delicate parts from being welded together. Secondly, the parts are limited to certain materials that are capable of forming strong friction welds. Additionally, the parts must be heavier, using more materials and thus at a greater cost to endure the severe stresses associated with the process. Finally, the friction welding process involves a secondary step, which involves setup and inspection to ensure a quality part.

An improvement in the art over friction welding in manufacturing the impeller discussed above involves sonic welding the two-piece impeller together. While the sonic welding procedure still involved the same additional costs and shortcomings, the sonic welding process allows for the use of more intricate designs and a marginal reduction in part weight.

Sonic welding involves the use of sound, or more specifically a tuned vibration, to heat up and join the parts together. With sonic welding, one half of the part is rigidly affixed to a mount and the second half is affixed to a moveable section which undergoes an intense cyclic vibration. The parts are then moved in contact with each other and the friction from the rapidly vibrating half in contact with the stationary half causes the thermoplastic at the point of contact to soften and flow. It is common practice to add various features to parts that concentrate friction along certain points of the weld line to improve the weld strength.

Sonic welding also includes many inherent deficiencies, such as extra cost, time and expense in manufacturing the impeller. Even with the use of specific features to concentrate friction, there can still be a problem involving weakness and potential failure at the weld line due to poor knitting of the plastic between the two parts.

The present invention addresses and corrects all the deficiencies of the earlier manufacturing methods while producing an impeller with superior properties and cost savings.

Accordingly, it is an object of the present invention to provide a onepiece impeller that has superior durability. It is another object of the present invention to provide a one-piece impeller that reduces the complexity involved with manufacturing. It is yet another object of the present invention to provide a one-piece impeller with a synthetic material that achieves the same performance as traditional two-piece impellers. It is a further object of the present invention to lower the cost of manufacturing an impeller in combination with superior performance capabilities. It is still a further object of the present invention to provide a one-piece impeller having superior stability and reduced mass. Another object of the present invention is to provide a one-piece impeller with reduced material usage and less scrap. Furthermore, it is an object of the present invention to reduce the amount of secondary operations in manufacturing the impeller.

SUMMARY OF THE INVENTION

The present invention achieves the above-described objectives by providing a one-piece impeller having a plurality of impeller blades, a central hub and an inlet support ring. The impeller of the present invention is preferably made of a stiff synthetic thermoplastic resin that has high durability and allows for ease of processing using machines, such as injection molding machines. This combination has been found to produce an impeller with superior cost and performance capabilities, which also satisfies the need for durability.

The impeller must be constructed from a relatively stiff material, for example, synthetic thermoplastic materials. Most notably, these synthetic thermoplastic materials are engineering resins because of their superior properties and dimensional stability. However, it is envisioned that non-engineering resins or commodity resins, such as olefins, could be used if properly modified with additives or fillers to provide the necessary dimensional stability and physical properties. The material selection for the present invention is much wider without the constrictions placed on the material selection by friction or sonic welding.

The present invention utilizes an improved design for impellers. It has been discovered that incorporating specific design features into the impeller allows the impeller to be injection molded in one step while still retaining, if not easily surpassing, the durability and performance of the prior art impeller. The one-piece impeller design replaces the cumbersome two-piece design that necessitated the secondary operations of molding separate pieces, inspecting the pieces for quality and then friction or sonic welding the components together. Furthermore, the impeller design of the present invention has much improved balance over the prior impeller designs right out of the mold.

Additionally, compatible additives may be added to the synthetic polymer of the present invention. Examples of common additives are stabilizers, fillers and processing aids. The final amount of additives is dependent on the exact polymer used and should be adjusted accordingly.

These and other objects of the present invention will be apparent from a reading of the following detailed description of the present invention.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
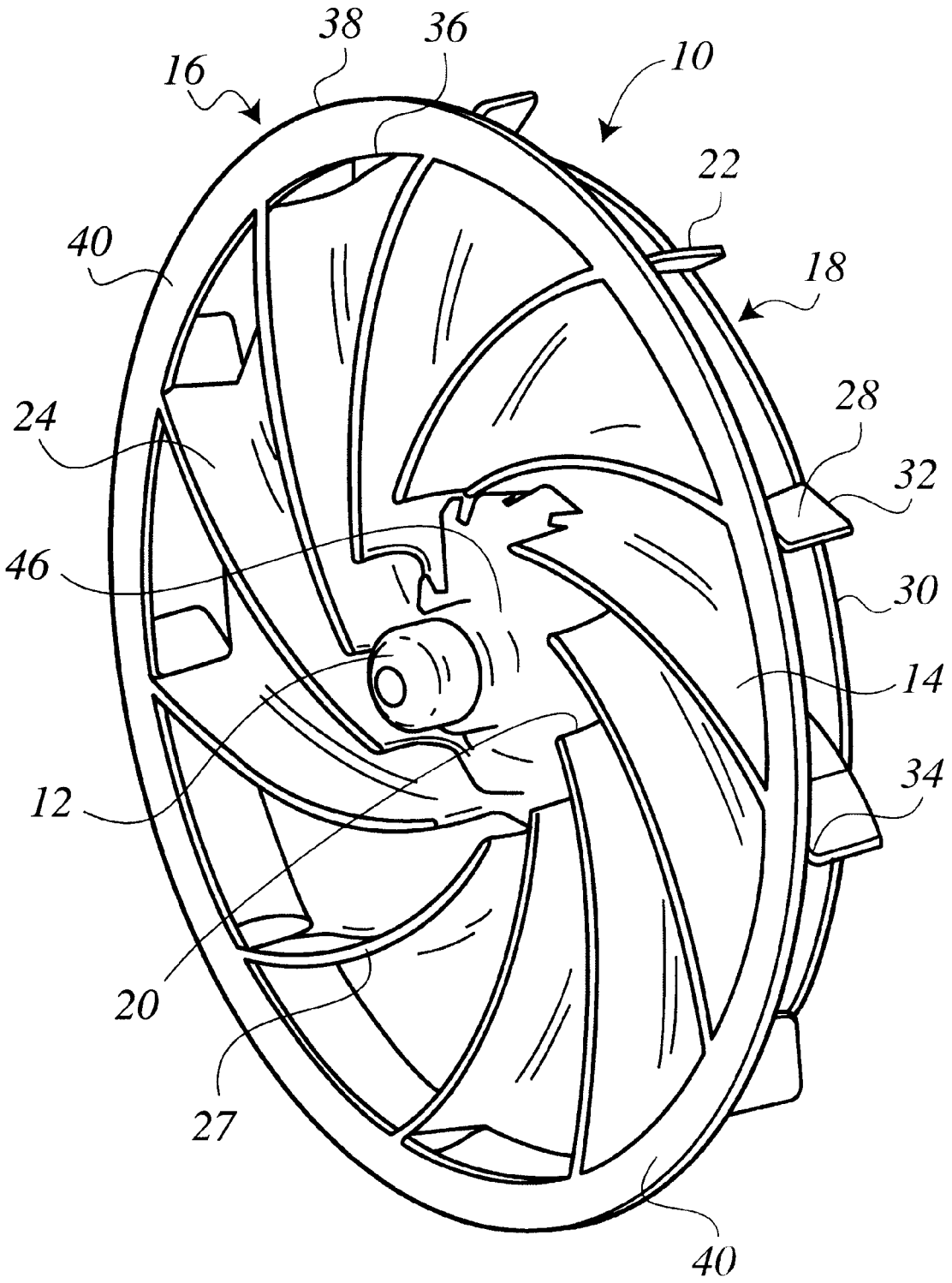
FIG. 1 is a front perspective view of the impeller of the preferred embodiment of the invention.
Figure 2:
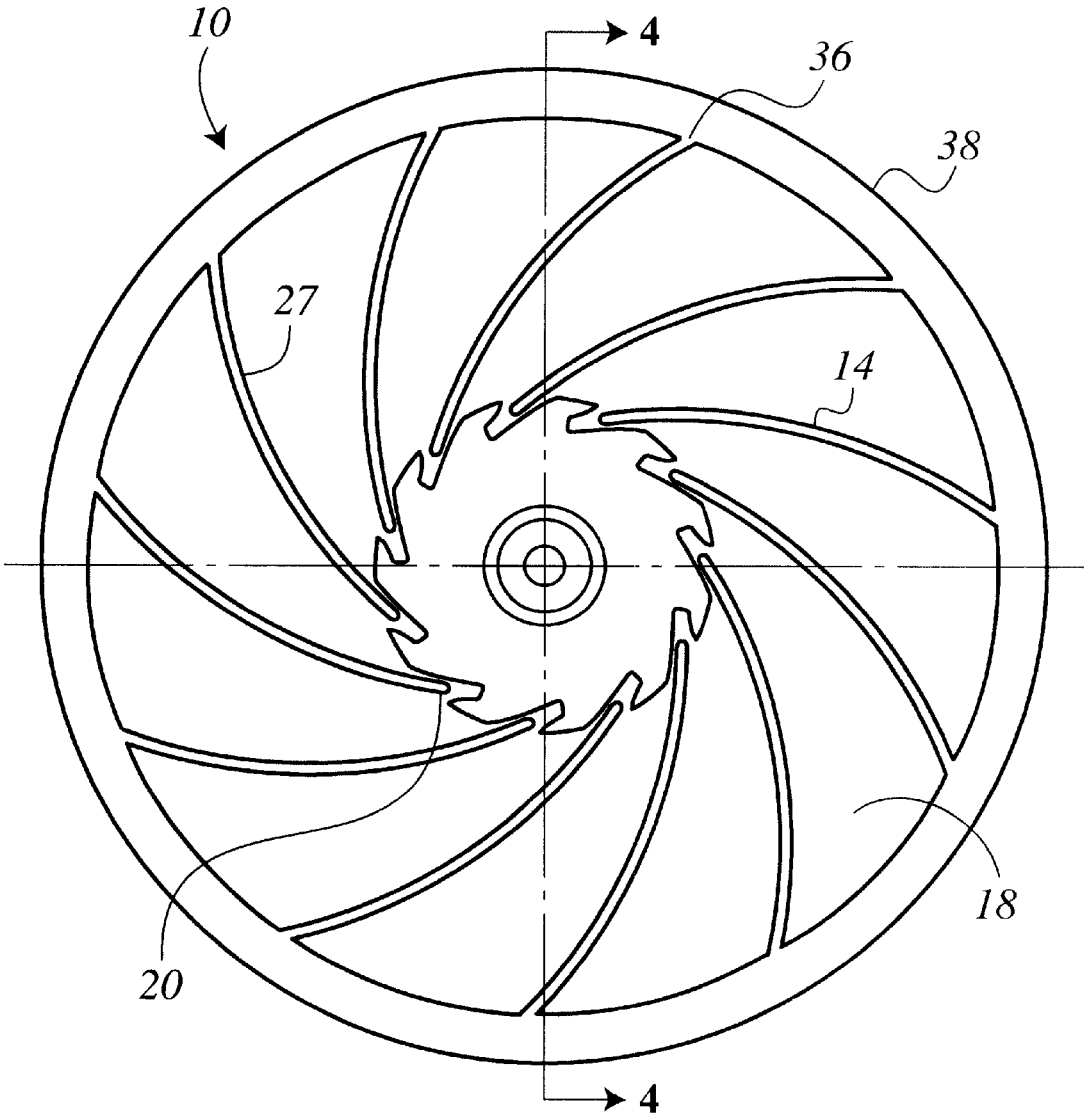
FIG. 2 is a front view of the impeller of the preferred embodiment.

Referring to FIGS. 1 and 2, there shown is a one-piece impeller 10 constructed in accordance with the present invention. The one-piece impeller 10 is designed to be mounted to a rotating shaft to direct a flow of air radially outward. The impeller 10 is preferably usable in connection with an AC motor or incorporated within a blower to direct a flow of air in a desired direction.

In the preferred embodiment of the invention shown in FIG. 1, the one-piece impeller 10 generally consists of a centrally located hub 12, a plurality of individual impeller blades 14, an inlet support ring 16 and a back plate 18 that are each integrally connected and formed as a single, molded item. In the preferred embodiment of the invention, the impeller 10 is manufactured using an injection molding process. Once the injection molding cycle has been finished, the impeller 10 is demolded, inspected and then ready for final use.

In the preferred embodiment of the invention, the materials chosen for the impeller 10 are any relatively stiff polymer that is dimensionally stable and durable based upon the environment in which the impeller will be used. An example of such a polymer that is available commercially from manufacturers such as General Electric under the name Valox® or Makrolon under the name 2800/2600. Other polymers that are stiff and dimensionally stable may be used in addition to those polymers specifically listed above. This includes polymers that achieve their properties through the addition of fillers, additives and blends to achieve the polymer of the properties desired.

Figure 4:
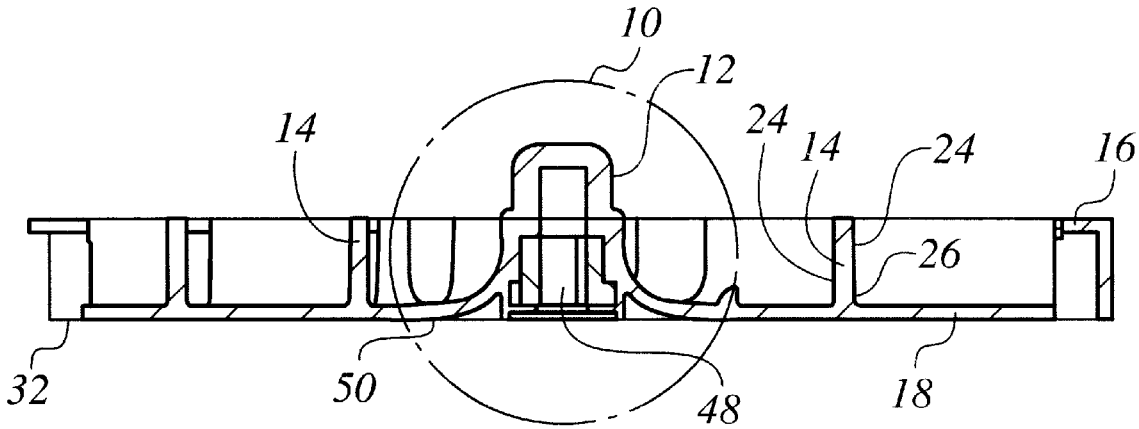
FIG. 4 is a section view taken along line 4—4 of FIG. 2 showing the hub and mating of the impeller blades to the back plate according to the invention.

Referring now to FIGS. 1 and 2, there shown is the one-piece impeller 10 constructed in accordance with the present invention. The impeller 10 includes a plurality of backward curved impeller blades 14 that each extend from an inner, leading edge 20 to an outer, trailing edge 22. As illustrated in FIGS. 1 and 4, each impeller blade 14 is defined by a pair of side walls 24 that define the thickness of each impeller blade. As can be seen in FIG. 4, the impeller side walls 24 are substantially perpendicular to the back plate 18 of the impeller 10. The perpendicular relationship between the impeller blades 14 and the back plate 18 allows for injection molding without intricate side actions or expensive secondary operations.

As can be seen in FIGS. 1 and 4, each impeller blade 14 includes a lower edge 26 that mates with and is integrally formed with the back plate 18. The interaction between the lower edge 26 and the back plate 18 provides further rigidity for each of the impeller blades 14. The height of each impeller blade 14 is defined by an upper edge surface 27.

Figure 3:
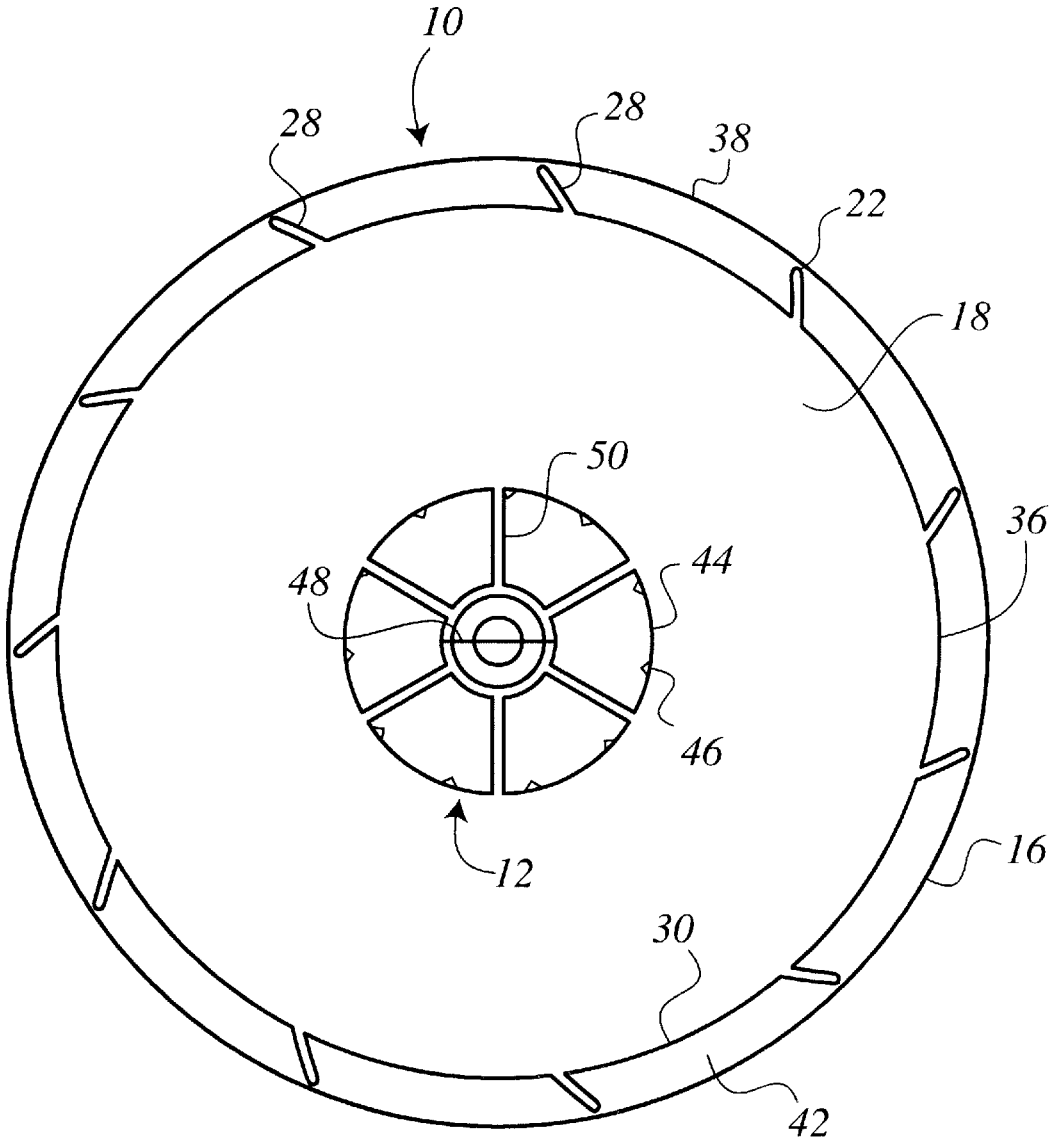
FIG. 3 is a back view of the impeller of the preferred embodiment.

Referring now to FIGS. 1 and 3, each of the impeller blades 14 includes an extended portion 28 that extends past the circular outer edge 30 of the back plate 18. The extended portion 28 of each impeller blade 14 extends past the outer edge 30 and includes a lower edge surface 32 and an upper edge surface 34. As can be seen in FIG. 4, the lower edge surface 32 is generally co-planar with the bottom surface of the back plate 18.

Referring now to FIGS. 1 and 3, the support ring 16 of the impeller 10 is integrally formed with each of the impeller blades 14 to provide enhanced stability for the impeller blades 14. As illustrated, the support ring 16 is an annular member defined by an inner circumferencial surface 36 and an outer circumferencial surface 38. The support ring 16 has a thickness defined between a front face surface 40 illustrated in FIG. 1 and a back face surface 42 shown in FIG. 3.

As can be understood in these figures, the back face surface 42 of the support ring 16 is integrally formed with the extended portion 28 of each impeller blade 14. Specifically, the back face 42 of the support ring 16 is integrally connected to each extended portion 28 of the impeller blades 14 along the upper edge surface 34 of the extended part in 28. As illustrated in FIG. 1, the front face surface 40 of the support ring 16 is generally co-planar with the upper edge surface 27 of each impeller blade 14. The support ring 16 provides for additional support for each of the impeller blades 14, which allows the impeller 10 to be molded as a single, unitary structure.

Referring now to FIG. 3, the back plate 18 has a substantially circular shape and is substantially flat. The back plate 18 extends between the outer edge surface 30 and an inner edge surface 44. As illustrated in FIG. 3, the inner edge surface 36 of the support ring 16 must have slightly greater diameter than the outer edge surface 30 of the rear support wall 18 for molding purposes. However, there is no limitation on the diameter of the outer edge surface 38 of the support ring 16, but ideally the diameter should be the minimum size required to provide adequate stiffening support for the impeller blades 14 to reduce unneeded mass and material usage.

Referring back to FIG. 3, the inner edge surface 44 of the back plate 18 mates with the outer hub wall 46 of the hub 12. As illustrated in FIG. 3, the hub 12 has an inner hub 48 that is adapted to be fitted onto a shaft or other mechanism to transfer rotating motion to the impeller. The inner hub 48 is supported by a series of radially extending support ribs 50. The support ribs 50 extend upward and mate with the outer surface of the hub 12 to provide greater strength for the hub 12.

Figure 5:
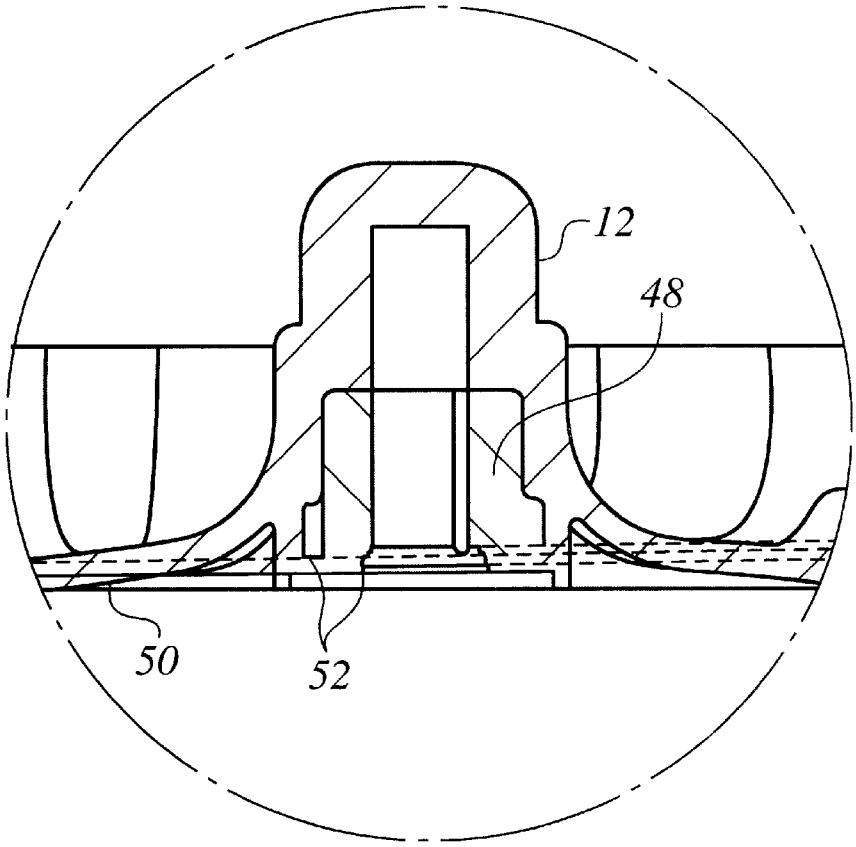
FIG. 5 is a magnified section view illustrating the hub of the impeller.

Referring now to FIGS. 4 and 5, there shown is a cross-sectional view of the inner hub 48. As previously described, the inner hub 48 is adapted to receive a shaft to transmit rotation to the impeller. The inner hub 48 has an inner radius that interconnects with a shaft. The inner hub 48 has a wall thickness 52 as illustrated in FIG. 5. The hub 12, the impeller blades 14, the inlet support ring 16 and the back plate 18 preferably all have the same thickness. The use of nearly constant wall thickness aides in the filling and cooling of the molds. Furthermore, the constant wall thickness of the impeller 10 prevents uneven shrinkage. When the wall thickness of a plastic part is not constant, different sections of the part cool at different rates and put stress on the part, potentially causing warpage.

It will be appreciated that the present specification discloses only one example out of convenience. However, it should be understood that the present invention is by no means limited to the particular embodiment disclosed herein, but also comprises any modifications and equivalence within the scope of the claims which follow the spirit of the invention disclosed.

Various alternatives and embodiments are contemplated as being within the scope of the following claims particularly pointing out and distinctly claiming the subject matter regarded as the invention.

I claim:

1. A one-piece impeller assembly mountable to an input shaft, the impeller assembly comprising:

a central hub having an outer hub surface and an inner hub, wherein said inner hub is adapted to receive the input shaft thereby allowing a rotational force to be transmitted to the impeller;

a plurality of impeller blades extending radially outward from an inner edge to an outer edge;

an inlet support ring having an back face surface, an inner edge surface and an outer edge surface, wherein each impeller blade is joined to the back face surface of the inlet support ring near the outer edge of the impeller blade; and a back plate having an outer edge surface, wherein each impeller blade is mounted to the back plate and wherein the diameter of the back plate outer edge surface is less than or equal to the diameter of inner edge surface of the inlet support ring, wherein each impeller blade includes an extended portion that extends radially outward past the outer edge surface of the back plate.

2. The one-piece impeller assembly of claim 1 wherein the impeller blades are backwards curving.

3. The one-piece impeller assembly of claim 1 wherein the impeller blades are backward inclined.

4. The one-piece impeller assembly of claim 1 wherein the impeller blades are radial.

5. The one-piece impeller assembly of claim 1 wherein the extended portion of the impeller blade is joined to the back face surface of the support ring.

6. The one-piece impeller assembly of claim 1 further comprising a plurality of radially extending support ribs and an inner rear wall edge wherein said outer hub surface mates with said inner rear wall edge, said radially extending support ribs extend from said inner hub and mates to said outer hub surface and said inner rear wall edge thereby providing support to said inner hub.

7. A one-piece impeller assembly mountable to an input shaft, the impeller assembly comprising:

a central hub having an outer hub surface and an inner hub, wherein said inner hub is adapted to receive the input shaft thereby allowing a rotational force to be transmitted to the impeller;

a plurality of impeller blades extending radially outward from an inner edge to an outer edge;

an inlet support ring having an back face surface, an inner edge surface and an outer edge surface, wherein each impeller blade is joined to the back face surface of the inlet support ring near the outer edge of the impeller blade;

a back plate having an outer edge surface, wherein each impeller blade is mounted to the back plate and wherein the diameter of the back plate outer edge surface is less than or equal to the diameter of inner edge surface of the inlet support ring;

an inner hub wall thickness;

an outer hub wall thickness;

a radially extending rib thickness;

an impeller wall thickness;

an inlet ring wall thickness; and a rear wall thickness, wherein all aforementioned said thicknesses are substantially the same thereby allowing uniform cooling and reduced material usage.

8. A one-piece impeller assembly mountable to an input shaft, the impeller assembly comprising:

a central hub adapted to receive the input shaft to allow the rotational force to be transmitted to the impeller assembly;

a back plate having an outer diameter defined by an outer edge surface;

a plurality of impeller blades extending radially outward from an inner edge surface to an outer edge surface, wherein the inner edge surface on each impeller blade is positioned near the central hub and wherein the impeller blade further includes an extended portion that extends radially outwardly from the outer edge surface of the back plate, wherein each extended portion is defined by the outer edge surface of the impeller blade; and an inlet support ring having an back face surface, the back face surface of the inlet support ring being joined to the extended portion of each impeller blade.

9. The impeller assembly of claim 8, wherein the inlet support ring is defined by an inner edge surface and an outer edge surface, wherein the diameter of the inner edge surface is less than or equal to the diameter of the outer edge surface of the back plate.

10. The one-piece impeller assembly of claim 9 wherein each of the impeller blades is generally perpendicular to the back plate.

* * * * *